US009869138B2

(12) United States Patent
Vanegas et al.

(10) Patent No.: US 9,869,138 B2
(45) Date of Patent: Jan. 16, 2018

(54) METHODS AND APPARATUS FOR RELEASABLY CONNECTING A CABLE WITH A TOOL

(71) Applicant: Schlumberger Technology Corporation, Sugar Land, TX (US)

(72) Inventors: Ricardo Vanegas, Houston, TX (US); Robert Michael Ramsey, Missouri City, TX (US); L. Michael McKee, Livingston, TX (US); Montie W. Morrison, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 543 days.

(21) Appl. No.: 14/464,485

(22) Filed: Aug. 20, 2014

(65) Prior Publication Data

US 2016/0053556 A1 Feb. 25, 2016

(51) Int. Cl.
*E21B 17/02* (2006.01)

(52) U.S. Cl.
CPC ..... *E21B 17/026* (2013.01); *E21B 17/023* (2013.01)

(58) Field of Classification Search
CPC ..... E21B 17/023; E21B 17/026
See application file for complete search history.

(56) References Cited

U.S. PATENT DOCUMENTS 2,187,007 A * 1/1940 Barnes ..... E21B 17/023 166/202
2,266,883 A * 12/1941 Lukes ..... E21B 17/023 403/365
3,031,218 A * 4/1962 Ellis ..... E21B 17/05 175/320
4,648,444 A * 3/1987 Busch ..... E21B 17/023 166/65.1
4,697,641 A * 10/1987 White ..... E21B 17/023 166/243
4,728,124 A * 3/1988 Righi ..... E21B 17/06 175/320
4,874,327 A * 10/1989 Ip ..... E21B 17/023 439/275
5,070,940 A * 12/1991 Conner ..... E21B 17/023 166/105
5,109,921 A 5/1992 Aracena
5,392,851 A * 2/1995 Arend ..... E21B 17/023 166/325
2008/0181555 A1* 7/2008 Head ..... E21B 17/023 385/13

(Continued)

FOREIGN PATENT DOCUMENTS

EP 0198672 A2 10/1986
EP 0898046 A2 2/1999
EP 1197631 A2 4/2002

OTHER PUBLICATIONS

Extended European Search Report issued in EP Patent Appl. No. 15178364.4 on Apr. 20, 2015.

*Primary Examiner* — Giovanna C. Wright
(74) *Attorney, Agent, or Firm* — Trevor G. Grove

(57) ABSTRACT

An apparatus for releasably connecting a cable with a tool that has an outer cone. The outer cone has a lower portion and an upper portion. A weak point is located between the lower portion and upper portion. The apparatus also includes an inner cone configured to fit within the outer cone.

7 Claims, 4 Drawing Sheets

(56) References Cited

U.S. PATENT DOCUMENTS

| | | | | |
|---|---|---|---|---|
| 2010/0181077 | A1 | 7/2010 | McKee | |
| 2013/0074309 | A1* | 3/2013 | Armstrong | E21B 17/023 29/428 |

* cited by examiner

METHODS AND APPARATUS FOR RELEASABLY CONNECTING A CABLE WITH A TOOL

CROSS-REFERENCE TO RELATED APPLICATIONS

None.

FIELD OF THE DISCLOSURE

The disclosure generally relates to methods and apparatus for releasably connecting a cable with a tool.

BACKGROUND

During wellbore operations it may become necessary to remove a cable from a tool. Often the removal of the cable from the tool can damage the cable or the tool.

SUMMARY

An embodiment of apparatus for releasably connecting a cable with a tool includes an outer cone. The outer cone has a lower portion and an upper portion, and a weak point is located between the lower portion and upper portion. The apparatus also includes an inner cone configured to fit within the outer cone.

Another example apparatus for releasably connecting a cable with a tool includes an assembly housing. An outer cone is located within the assembly housing. The apparatus also includes a weak point. The weak point is configured to maintain the outer cone fixed relative to the assembly housing. The weak point fractures after application of a predetermined force, and at least a portion of the outer cone is configured to move relative to the assembly housing after fracture of the weak point. The apparatus also includes an inner cone located within the outer cone. The inner cone is configured to at least partially separate from the outer cone when the outer cone moves.

An example method of releasably connecting a cable with a tool includes connecting an assembly housing with a downhole tool. The assembly housing has an outer cone located therein. The method also includes placing a cable through the outer cone, and the outer cone has a weak point. The method also includes inserting an inner cone into the outer cone, and the outer cone and the inner cone cooperate to hold the armor wire therein.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example apparatus for releasably connecting a cable with a tool includes an outer cone. The outer cone has a lower portion and an upper portion, and a weak point is located between the lower portion and upper portion. The weak point can be formed by machining or forming a reduced thickness area between the upper portion and the lower portion. The weak point can be formed using any now known or future known techniques. The apparatus can also include an inner cone that is configured to fit within the outer cone.

Another example apparatus for releasably connecting a cable with a tool includes an assembly housing. An outer cone is located within the assembly housing.

The example apparatus also includes a weak point that is configured to maintain the outer cone fixed relative to the assembly housing until the weak point fractures. The weak point can be one or more tension members formed by milling or removing material from a portion of the outer cone, one or more shear members, connected tension beams, or the like. Illustrative shear members include shear pins, dowels, shear screws, threads, or the like.

An inner cone is located within the outer cone, and the inner cone is configured to at least partially separate from the outer cone. In one or more embodiments, an intermediate cone is located between the outer cone and inner cone.

In one or more embodiments, a first stop is located in the assembly housing, and the first stop is configured to engage the inner cone when the outer cone moves relative to the assembly housing. A second stop can be located in the assembly between the first stop and outer cone, and the second stop can be configured to engage the intermediate cone when the outer cone moves relative to the assembly housing.

Figure 1:
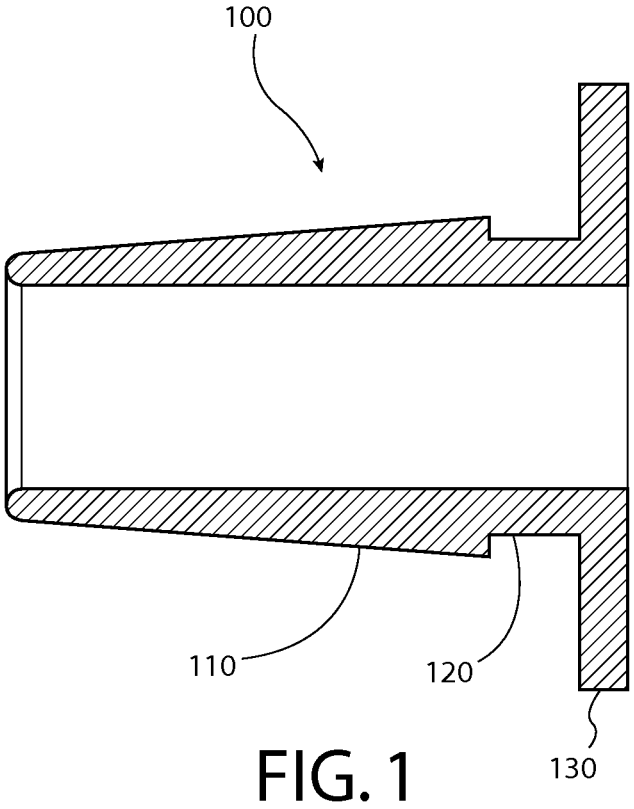
FIG. 1 depicts a cut view of an example outer cone.

FIG. 1 depicts a cut view of an example outer cone. The outer cone 100 includes a first portion 110 and a second portion 130. A weak point 120 is located between the portions 110 and 130. The weak point 120 can be a machined tolerance or groove in the outer cone. The weak point 120 is configured to break at a predetermined force. The predetermined force can be any desired force. For example the predetermined force can be from about 10 kpsi to about 60 kpsi. The outer cone 100 can be made from any material. Illustrative materials include alloys, steel, composites, or the like.

Figure 2:
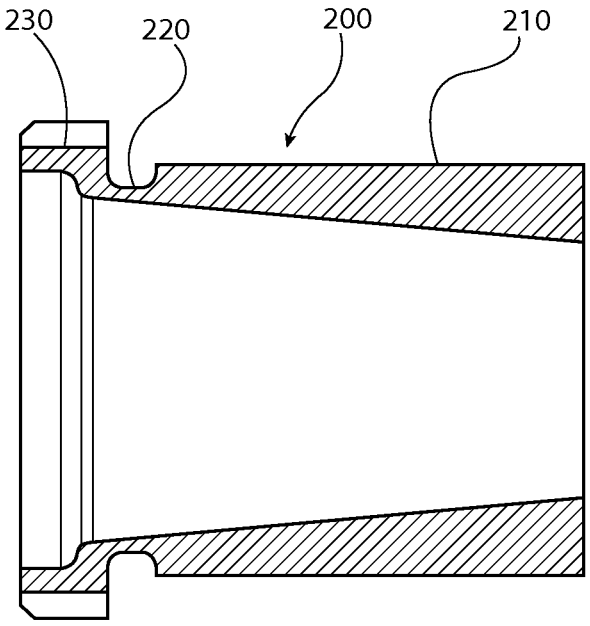
FIG. 2 depicts a schematic of another example of an outer cone.

FIG. 2 depicts a schematic of another example of an outer cone. The outer cone 200 includes a first portion 210 and a second portion 230. A weak point 220 is located between the first portion 210 and the second portion 230.

Figure 3:
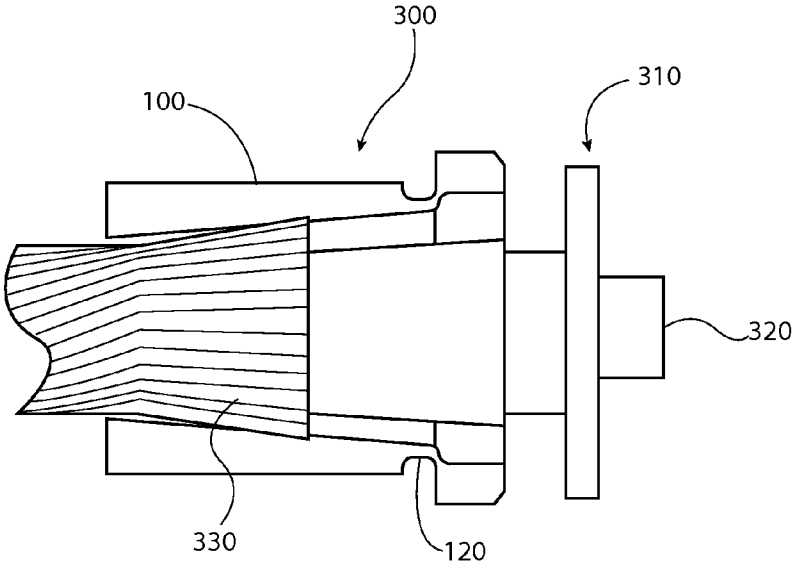
FIG. 3 depicts a schematic of an example apparatus holding armor wires of a cable in place.

FIG. 3 depicts a schematic of an example apparatus holding armor wires of a cable in place. The apparatus 300 includes the outer cone 100 and an inner cone 310. A cable 320 can be placed through the inner cone 310 and the outer cone 100. The armor wire 330 of the cable 320 can be located between the inner cone 310 and the outer cone 100. The inner cone 310 and the outer cone 100 can cooperate to hold the cable in place. The weak point 120 can prevent the outer cone portions from moving relative to one another.

If removal of the cable is desired, tension can be applied to the cable 320 until a predetermined force is achieved. The weak point 120 can break at the predetermined force, allowing the first portion of the outer cone 100 to move relative to the second portion of the outer cone 100. The movement of the portions of the outer cone 100 can force the inner cone 310 at least partially out of the outer cone 100. The armor wire 330 is free to move when the inner cone 310 is moved out of the outer cone 100, and the cable 320 can be recovered.

Figure 4:
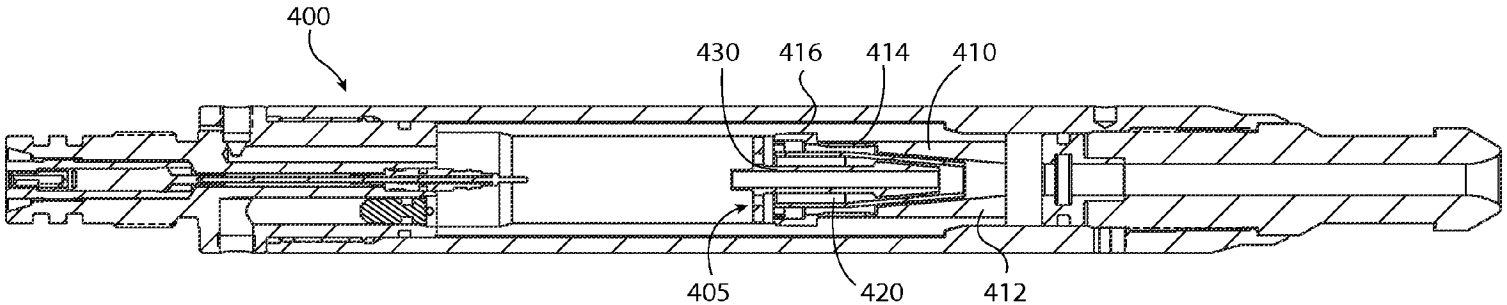
FIG. 4 depicts an additional example of an apparatus located in an assembly.

FIG. 4 depicts an additional example of an apparatus located in an assembly. The apparatus 405 can be located in a sealed assembly 400. The apparatus 405 includes an outer cone 410, an intermediate cone 420, and an inner cone 430. The outer cone 410 includes a first portion 412, a second portion 416, and a weak point 414. The weak point 414 is depicted as tension members created by forming windows in the outer cone 410. The strength of the weak point 414 can be determined by the size of the window formed in the outer cone 410. For example, a small window can be formed in the outer cone 410 to provide a weak point with a high yield strength. The yield strength of the weak point 414 can be a function of the material properties and the size of the window formed in the outer cone.

In operation, a cable (not shown) can be placed through the inner cone 430, the intermediate cone 420, and the outer cone 410. The cable can have a first armor layer and a second armor layer. The first armor layer can be placed between the intermediate cone 420 and the outer cone 410. The second armor layer can be placed between the intermediate cone 420 and the inner cone 430.

If removal of a cable from the apparatus is desired, tension can be applied to the cable until the weak point 414 ruptures, allowing the first portion 412 to move away from the second portion 416. The movement of the first portion 412 will cause the intermediate cone 420 to be at least partially removed from the outer cone 410 and the inner cone 430 to be at least partially removed from the outer cone 410 and the intermediate cone 420. After the intermediate cone 420 and inner cone 430 are at least partially removed from the outer cone 410 and the inner cone 430 is at least partially removed from the intermediate cone 420, the cable is free to be retrieved.

Figure 5:
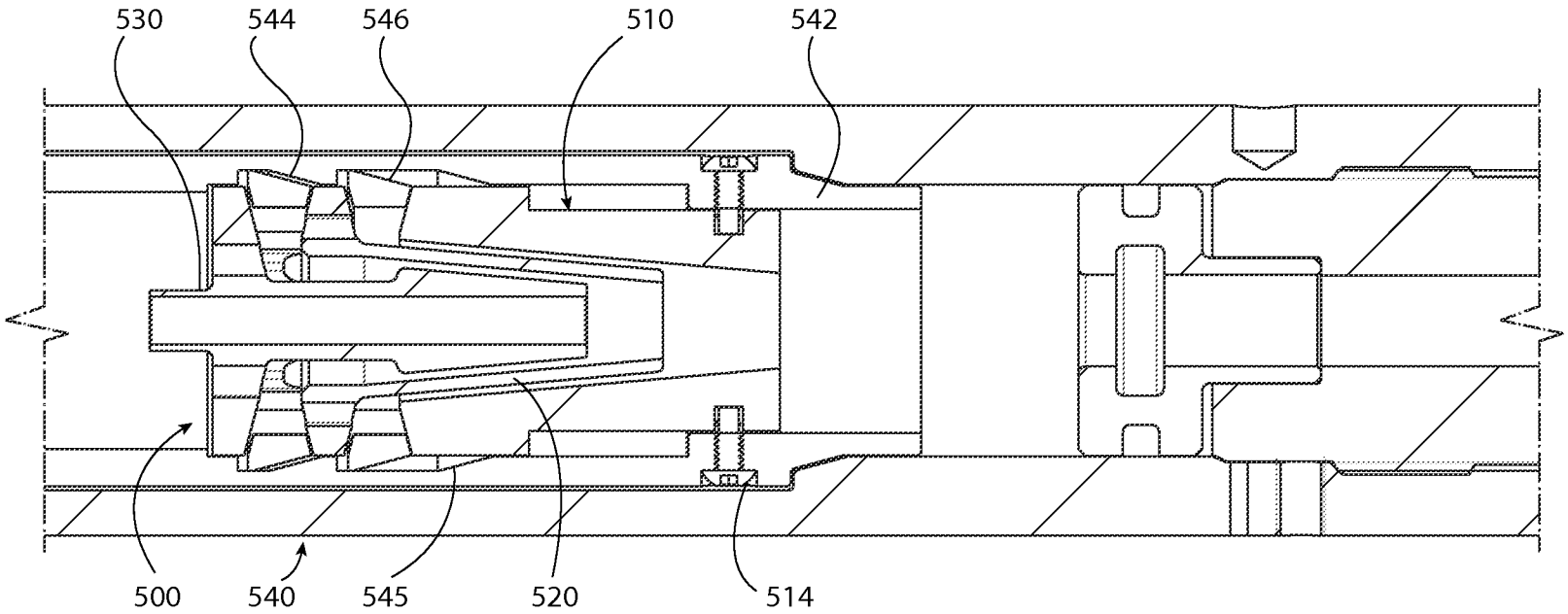
FIG. 5 depicts another example of apparatus located in an assembly.

FIG. 5 depicts another example of apparatus located in an assembly. The apparatus 500 can be located in a sealed assembly 540. The apparatus 500 can include an outer cone 510, an intermediate cone 520, and an inner cone 530. A weak point 514 can be engaged with the outer cone 510 and an assembly housing 542. The weak point 514 can prevent the outer cone 510 from moving relative to the assembly housing 542.

The assembly housing 542 can have a first stop 544 and a second stop 546. The stops 544 and 546 can be wedge rings, ramps, shoulders, or the like. The assembly housing 542 can also have a release ramp 545. However, in one or more embodiments, the assembly housing does not need the release ramp 545.

In operation, a cable can be placed through the inner cone 530, the intermediate cone 520, and the outer cone 510. The cable can have a first layer of armor wire and a second layer of armor wire. The first layer of armor wire can be located between the outer cone 510 and the intermediate cone 520, and the second layer of armor wire can be located between the intermediate cone 520 and the inner cone 530. The weak point 514 can prevent the outer cone 510 from moving relative to the assembly housing 542. If retrieval of the cable is desired, tension can be applied to the cable to break the weak point 514. The outer cone 510 can move, and the stops 544 and 546 can cause the inner cone 530 and intermediate cone 520 to be removed from the outer cone 510; thereby, releasing the cable therefrom.

Figure 6:
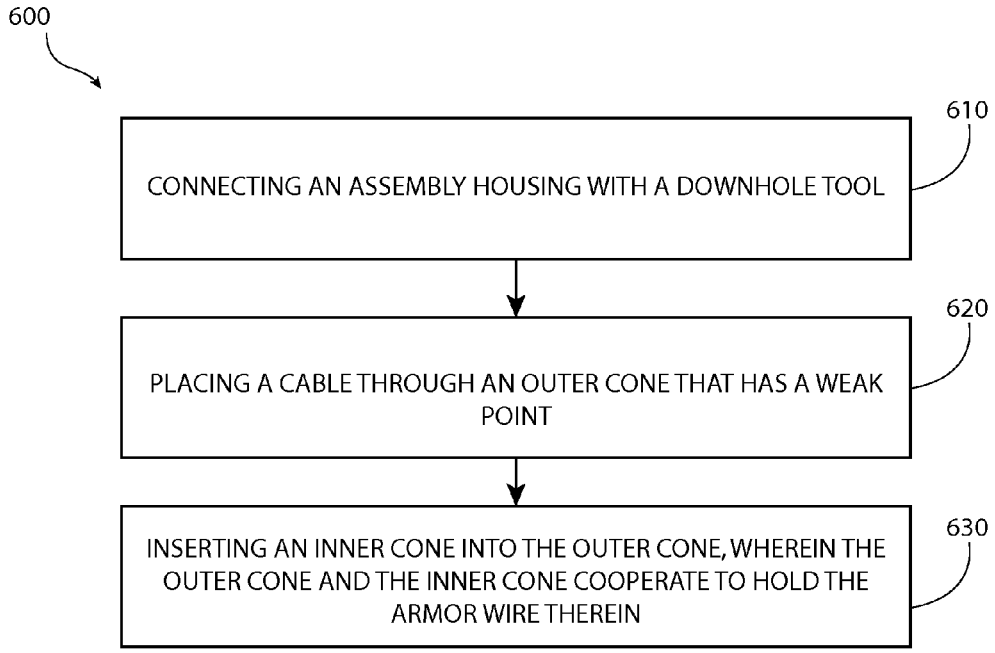
FIG. 6 depicts an example method of releasably connecting a cable to a tool.

FIG. 6 depicts an example method of releasably connecting a cable to a tool. The method 600 is represented by a series of blocks or operations. The method 600 includes connecting an assembly housing with a downhole tool (Block 610). The assembly housing can have an outer cone located therein.

The method 600 also includes placing a cable through an outer cone that has a weak point (Block 620). The method 600 also includes inserting an inner cone into the outer cone, wherein the outer cone and the inner cone cooperate to hold the armor wire therein (Block 630).

Figure 7:
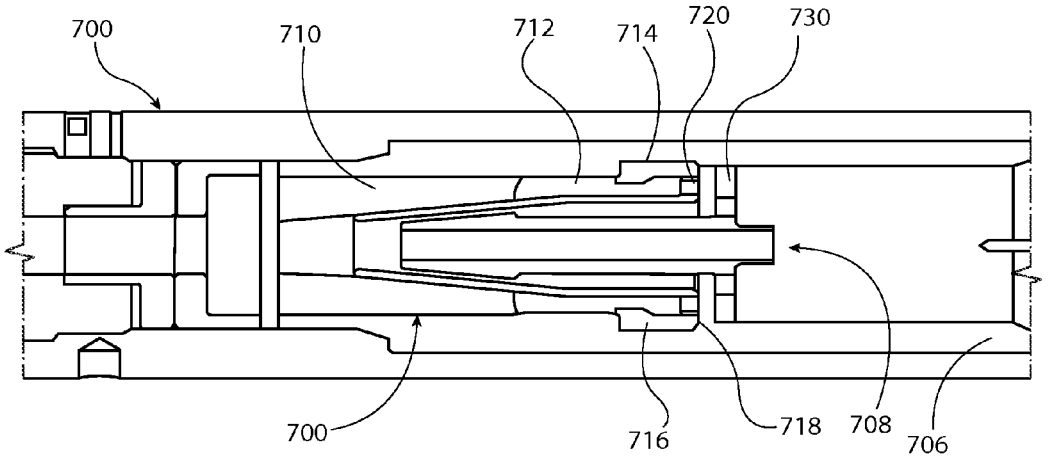
FIG. 7 depicts another example apparatus located in an assembly.

FIG. 7 depicts another example apparatus located in an assembly.

The apparatus 708 is located in sealed assembly 700. The apparatus 708 includes an outer cone 710, an intermediate cone 720, and an inner cone 730. The outer cone 710 is connected with an upper portion 714 by tension beams 712. The tension beams 712 can be connected with outer cone 710 and upper portion 714 by welding, adhesive, fasteners, or the like. The tension beams 712 are configured to break upon application of a predetermined force. The upper portion 714 has a first travel stop 716 and a second travel stop 718.

If release of a cable (not shown) from the sealed assembly 700 is desired, tension can be applied to the cable to rupture the tension members 712, allowing the outer cone 710 to move relative to the upper portion 714 and an assembly housing 706. The assembly housing 706 is configured to keep the upper portion 714 from moving relative thereto. The intermediate cone 720 can engage the first travel stop 716, allowing the intermediate cone 720 to at least partially separate from the outer cone 710. The inner cone 730 can engage the second travel stop 718, allowing the inner cone 730 to at least partially separate from the intermediate cone. The cable can then be free to release from the apparatus 710 and the sealed assembly 700.

Although example assemblies, methods, systems have been described herein, the scope of coverage of this patent is not limited thereto. On the contrary, this patent covers every method, nozzle assembly, and article of manufacture fairly falling within the scope of the appended claims either literally or under the doctrine of equivalents.

What is claimed is:

1. An apparatus for releasably connecting a cable with a tool, wherein the apparatus comprises:

an outer cone, wherein the outer cone has a lower portion and an upper portion, wherein a weak point is located between the lower portion and upper portion; and an inner cone configured to fit within the outer cone, wherein the outer cone and inner cone are located in an assembly housing, and wherein a first stop is located in the assembly housing, wherein the first stop is configured to engage the inner cone when the outer cone moves relative to the assembly housing.

2. The apparatus of claim 1, wherein the weak point comprises tension members in the outer cone.

3. The apparatus of claim 2, further comprising an intermediate cone located between the inner cone and the outer cone.

4. An apparatus for releasably connecting a cable with a tool, wherein the apparatus comprises:

an assembly housing;

an outer cone located within the assembly housing;

a weak point configured to maintain the outer cone fixed relative to the assembly housing, wherein the weak point fractures after application of a predetermined force, and wherein at least a portion of the outer cone is configured to move relative to the assembly housing after fracture of the weak point; and an inner cone located within the outer cone, wherein the inner cone is configured to at least partially separate from the outer cone, wherein a first stop is located in the assembly housing, wherein the first stop is configured to engage the inner cone when the outer cone moves relative to the assembly housing.

5. The apparatus of claim 4, further comprising an intermediate cone located between the outer cone and the inner cone.

6. The apparatus of claim 5, wherein the weak point is a shear member connected with the assembly housing and the outer cone.

7. The apparatus of claim 6, wherein a second stop is located in the assembly, wherein the second stop is between the first stop and the outer cone, and wherein the second stop is configured to engage the intermediate cone when the outer cone moves relative to the assembly housing.

* * * * *